US008931321B2

(12) United States Patent
Ueoka et al.

(10) Patent No.: US 8,931,321 B2
(45) Date of Patent: Jan. 13, 2015

(54) HOT ROLLED STEEL SHEET COOLING APPARATUS

(75) Inventors: Satoshi Ueoka, Chiba (JP); Hirokazu Sugihara, Fukuyama (JP); Takashi Kuroki, Kawasaki (JP); Nobuo Nishiura, Kawasaki (JP); Tsutomu Sugiyama, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/260,870

(22) PCT Filed: Mar. 25, 2010

(86) PCT No.: PCT/JP2010/055991

§ 371 (c)(1), (2), (4) Date: Dec. 20, 2011

(87) PCT Pub. No.: WO2010/114083

PCT Pub. Date: Oct. 7, 2010

(65) Prior Publication Data

US 2012/0103052 A1 May 3, 2012

(30) Foreign Application Priority Data

Mar. 30, 2009 (JP) ..... 2009-081608
Jan. 19, 2010 (JP) ..... 2010-008683

(51) Int. Cl.
*B21D 37/16* (2006.01)
*B21B 45/02* (2006.01)

(52) U.S. Cl.
CPC ..... *B21B 45/0233* (2013.01); *B21B 45/0218* (2013.01)
USPC ..... 72/201; 72/342.2

(58) Field of Classification Search
USPC ..... 72/201, 236, 342.5, 342.6, 202, 342.2, 72/342.94, 286, 364, 128
See application file for complete search history.

(56) References Cited

U.S. PATENT DOCUMENTS 5,212,975 A * 5/1993 Ginzburg ..... 72/201
7,779,661 B2 * 8/2010 Fujibayashi et al. ..... 72/201

(Continued)

FOREIGN PATENT DOCUMENTS

EP 1 210993 A1 6/2002
JP 61-7015 A 1/1986
JP 62-260022 11/1987

(Continued)

OTHER PUBLICATIONS

International Search Report dated Jul. 6, 2010, application No. PCT/JP2010/055991.

(Continued)

*Primary Examiner* — Shelley Self
*Assistant Examiner* — Pradeep C Battula
(74) *Attorney, Agent, or Firm* — RatnerPrestia

(57) ABSTRACT

A hot rolled steel sheet cooling apparatus includes a gradual cooling header 2 including a rod-like cooling water nozzle 3 for gradual cooling and a rapid cooling header 4 including a rod-like cooling water nozzle 5 for rapid cooling such that the headers constitute a cooling unit 9. The cooling unit 9 includes an elevating unit 7 capable of moving upward and downward in unison with the cooling unit. In cooling the upper surface of a hot rolled steel sheet (hot rolled steel strip or steel plate), uniform and stable cooling is achieved while both of high cooling rate and low cooling rate are ensured.

16 Claims, 8 Drawing Sheets

(56) References Cited

U.S. PATENT DOCUMENTS

| | | | | |
|---|---|---|---|---|
| 7,954,350 | B2 * | 6/2011 | Takahama et al. | 72/201 |
| 8,231,826 | B2 * | 7/2012 | Ueoka et al. | 72/201 |

FOREIGN PATENT DOCUMENTS

| | | | |
|---|---|---|---|
| JP | 5-70709 | | 9/1993 |
| JP | 10263669 | | 10/1998 |
| JP | 2002-239623 | | 8/2002 |
| JP | 2004-66308 | A | 3/2004 |
| JP | 2008-73765 | A | 4/2008 |
| JP | 2008-73766 | A | 4/2008 |
| JP | 2008-168316 | A | 7/2008 |
| JP | 2008-212943 | A | 9/2008 |

OTHER PUBLICATIONS

European Search Report dated Mar. 20, 2013, application No. EP10758854.

* cited by examiner

HOT ROLLED STEEL SHEET COOLING APPARATUS

CROSS REFERENCE TO RELATED APPLICATIONS

This application is the U.S. National Phase application of PCT International Application No. PCT/JP2010/055991, filed Mar. 25, 2010, and claims priority to Japanese Patent Application No. 2009-081608, filed Mar. 30, 2009, and Japanese Patent Application No. 2010-008683, filed Jan. 19, 2010, the disclosures of which PCT and priority applications are incorporated herein by reference in their entirely for all purposes.

FIELD OF THE INVENTION

The present invention relates to a cooling apparatus used to cool a hot rolled steel sheet (hot rolled steel strip or steel plate), serving as rolled steel, in a hot rolling line.

BACKGROUND OF THE INVENTION

A hot rolled steel sheet (hot rolled steel strip or steel plate) is manufactured by rolling a slab heated at a high temperature such that the slab has a desired size. In this case, the hot rolled steel sheet is cooled using cooling water by a cooling apparatus during hot rolling or after finish rolling. As for the purpose of water cooling (cooling with cooling water), controlling deposit or transformed structure of the hot rolled steel sheet by water cooling mainly adjusts the quality of material in order to obtain intended strength, ductility, and the like. In particular, accurately controlling a finish cooling temperature is the most important to manufacture hot rolled steel sheets having intended material properties without variation.

As a result of soaring rare metal costs, methods have been developed which improve mechanical properties by transformed structure control based on cooling instead of alloy composition adjustment. In the above-described water cooling, there is a great need for wide range control of cooling rate in response to requirements for material quality.

In a run-out table of a typical cooling apparatus in a hot rolled steel strip manufacturing line, arrangement of pipe laminar cooling for the upper surface and spray cooling for the lower surface is often used. The flow rate of cooling water is about 700 to 1000 L/min·m$^2$. For a steel strip having a thickness of 3 mm, a cooling rate of about 70° C./s is provided. For 25 mm steel which has a typical thickness of a relatively thick steel strip (high tensile strength steel for shipbuilding or steel for line pipe), a cooling rate of about 10° C./s is provided in this cooling apparatus.

In the hot rolled steel strip manufacturing line, steel strips to be processed have a wide range of thicknesses, 1.2 to 25 mm. In addition, for example, steel emphasizing workability and steel emphasizing toughness are processed. There is a need to increase a cooling rate only when a thick steel strip is processed. As a method of regulating the cooling rate, it is often necessary to regulate the cooling water flow rate.

In the hot rolled steel strip manufacturing line, the passing performance of a steel strip varies depending on, in particular, thickness. Unfortunately, difficulties occur. Specifically, for example, as regards high tensile steel for automobile, most of steel strips have thicknesses from about 1.2 to 3.0 mm. Such a steel strip of this size has poor stiffness and provides high passing speed. Accordingly, during conveyance by table rollers, a lift force caused by air resistance or fluid resistance generated by cooling water is applied to the steel strip, so that the steel strip tends to bounce. In particular, an ultrathin steel strip having a thickness of about 1.2 mm bounces up to about 1000 mm on a pass line. It therefore may be necessary to cool a thin steel strip on the pass line from a distance of 1000 mm or more at a relatively low water flow rate. Accordingly, a related-art run-out table uses a pipe laminar cooling unit capable of performing distant cooling to cool the upper surface of a steel strip.

In the typical cooling apparatus with the arrangement of pipe laminar cooling for the upper surface and spray cooling for the lower surface, however, cooling at a high water flow rate has various problems.

For example, as the cooling water flow rate of upper-surface pipe laminar cooling is increased, the velocity of flow in each pipe is extremely increased. Thus, the spray of cooling water changes from continuous laminar flow to jet flow. In the pipe laminar, cooling water is sprayed from pipes, each having a nozzle orifice diameter of about 10 to 25 mm, arranged at a distance of about 1000 to 1500 mm from the steel strip conveying line. Disadvantageously, part of jetted cooling water is formed into droplets, so that the continuity of cooling water is lost. In addition, since part of the jetted cooling water spatters, efficient cooling is not achieved.

It is therefore difficult to remarkably change a cooling rate during cooling of a hot rolled steel strip on the run-out table. Traditionally, the composition of steel has been mainly adjusted so as to be suitable for established cooling rates.

As regards steel plates, the thicknesses of products range from 6 to 100 mm, namely, the variations in thicknesses are remarkably wide. As a steel plate is thicker, the cooling rate decreases. Accordingly, as a steel plate is thicker, the amounts of alloying elements are increased to satisfy mechanical properties, such as strength and toughness. There is therefore a need to increase a cooling rate for a thicker steel plate as much as possible in order to reduce a change in cooling rate depending on thickness, as in the case of hot rolled steel strips.

To solve the above-described problem, for example, as means for ensuring a cooling rate for thick-sized steel plate, a method of cooling with a group of columnar jet flows is disclosed in PTL 1 and PTL 2, which describe a technique of spraying cooling water from a position relatively close to a steel sheet to achieve uniform cooling.

PTL 3 discloses a technique of spraying cooling water through slit nozzle units, provided with an elevating mechanism, arranged so as to face each other in a conveying direction and ensuring a cooling rate in a wide range using laminar nozzles and spray nozzles separated from the units such that stable cooling is achieved.

PATENT LITERATURE

PTL 1: Japanese Unexamined Patent Application Publication No. 10-263669

PTL 2: Japanese Unexamined Patent Application Publication No. 2002-239623

PTL 3: Japanese Unexamined Patent Application Publication No. 62-260022

SUMMARY OF THE INVENTION

A problem of the technique disclosed in PTL 1 and PTL 2 is that it is difficult to accomplish both of passing performance and cooling uniformity. Specifically, in the use of the columnar jet flow group, since the number of nozzles is large, a method of reducing the total flow rate using nozzles each having a relatively small orifice diameter (nozzles having an orifice diameter $\phi$ of about 3 to 10 mm) is used. To spray water at a high flow rate, the water tends to be jetted because the nozzle orifice diameter is small. It therefore may be necessary to arrange the nozzles at a short distance from a steel sheet. On the other hand, if cooling water is reduced, the water is discontinuously sprayed due to its surface tension during falling such that droplets fall. As described above, when a thin steel sheet passes, it may be necessary to spray water at a low flow rate from a long distance. If the flow rate of each nozzle is reduced, temperature variations may occur because cooling water is discontinuously sprayed due to the surface tension during falling. On the other hand, if the flow rate of each nozzle is increased and the number of spraying nozzles is reduced, water significantly spatters because the water is jetted as droplets, so that efficient cooling is not achieved. It therefore may be necessary to reduce the distance between the steel sheet and the nozzles. In this case, if the nozzles are moved closer to a thin steel sheet, such as 1.2 mm steel, than necessary, it is difficult to allow passage of the steel sheet because it tends to bounce. As described above, a narrow range of flow rates has to be selected in order to achieve stable cooling by a single apparatus.

On the other hand, according to the technique disclosed in PTL 3, headers having different cooling rates are separately arranged. To manufacture a thin steel sheet, the slit nozzle units are drawn by the elevating mechanism and the separated laminar nozzles and spray nozzles each having low cooling performance are used to resolve the problem. When the cooling rate has to be increased to process a thick steel sheet, the slit nozzles are moved downward and the slit nozzles having high cooling performance and the laminar nozzles and spray nozzles having the low cooling performance are used in combination to resolve the problem to some extent.

To stably increase the cooling rate in order to process a thick steel sheet according to the technique disclosed in PTL 3, the surface temperature is temporarily reduced by slit nozzle cooling which allows strong cooling and, after that, laminar and spray cooling which allows gradual cooling is performed. In order to achieve a high cooling rate in a cooling apparatus allowing gradual cooling while cooling time is extended to some extent, the length of installation of the slit nozzles has to be increased to some extent. On the other hand, if the apparatus is installed in a limited space, the installation length of the laminar and spray nozzles having the low cooling performance arranged downstream has to be reduced. As regards an installation space of a cooling apparatus for a hot rolled steel strip or steel plate, the space is not sufficient because many of manufacturing lines were constructed years ago. New construction may have a problem in terms of initial investment because the installation area of a facility is increased.

The present invention has been made in consideration of the above-described circumstances and provides a hot rolled steel sheet cooling apparatus capable of achieving uniform and stable cooling while ensuring both of high cooling rate and low cooling rate for cooling the upper surface of a hot rolled steel sheet (hot rolled steel strip or steel plate).

To solve the above-described problems, the following features are provided.

[1] A cooling apparatus for cooling a hot rolled steel sheet, including a header including a rod-like cooling water nozzle for gradual cooling and a header including a rod-like cooling water nozzle for rapid cooling such that the headers constitute a cooling unit, wherein the cooling unit includes an elevating unit capable of moving upward and downward in unison with the cooling unit.

[2] The hot rolled steel sheet cooling apparatus according to the above-described [1], wherein in the cooling unit, the rod-like cooling water nozzle for rapid cooling is disposed upstream and/or downstream of the rod-like cooling water nozzle for gradual cooling in a conveying direction of the hot rolled steel sheet.

[3] The hot rolled steel sheet cooling apparatus according to the above-described [1] or [2], wherein the cooling unit is set by an elevating function of the elevating unit such that when the rod-like cooling water nozzle for gradual cooling is used, the distance between the hot rolled steel sheet and an end of the nozzle is greater than or equal to 1000 mm, and when the rod-like cooling water nozzle for rapid cooling is used, the distance between the hot rolled steel sheet and an end of the nozzle ranges from 5 to 50 times the orifice diameter of the nozzle.

[4] The hot rolled steel sheet cooling apparatus according to any one of the above-described [1] to [3], wherein a draining unit is disposed on each side of the cooling unit in the conveying direction of the hot rolled steel sheet.

[5] The hot rolled steel sheet cooling apparatus according to the above-described [4], wherein the draining unit is a draining roll.

[6] The hot rolled steel sheet cooling apparatus according to any one of the above-described [1] to [5], wherein the rod-like cooling water nozzle for gradual cooling is disposed over a table roller conveying the hot rolled steel sheet.

[7] The hot rolled steel sheet cooling apparatus according to any one of the above-described [1] to [5], wherein the rod-like cooling water nozzle for gradual cooling is disposed over a spraying position of a lower surface cooling nozzle disposed between table rollers conveying the hot rolled steel sheet.

[8] The hot rolled steel sheet cooling apparatus according to any one of the above-described [1] to [7], wherein a flat protector configured to protect the rod-like cooling water nozzle for gradual cooling and the rod-like cooling water nozzle for rapid cooling is connected to the cooling unit, the protector has a guide hole for passage of cooling water, and cooling water is sprayed through the guide hole from the rod-like cooling water nozzle for gradual cooling and the rod-like cooling water nozzle for rapid cooling.

[9] The hot rolled steel sheet cooling apparatus according to any one of the above-described [1] to [8], wherein the rod-like cooling water nozzle for gradual cooling has a nozzle orifice diameter greater than or equal to 10 mm and provides a nozzle outlet flow velocity less than or equal to 3 m/s.

[10] The hot rolled steel sheet cooling apparatus according to any one of the above-described [1] to [9], wherein the rod-like cooling water nozzle for rapid cooling has a nozzle orifice diameter less than or equal to 10 mm and provides a nozzle outlet flow velocity greater than or equal to 7 m/s.

[11] The hot rolled steel sheet cooling apparatus according to any one of the above-described [1] to [10], wherein a plurality of rod-like cooling water nozzles for gradual cooling including the rod-like cooling water nozzle for gradual cooling are arranged at intervals 1.5 to 5 times the nozzle orifice diameter in the width direction of the hot rolled steel sheet subjected to cooling so as to form a cooling nozzle row, and one to three cooling nozzle rows are arranged in the header.

[12] The hot rolled steel sheet cooling apparatus according to any one of the above-described [1] to [11], wherein a plurality of rod-like cooling water nozzles for rapid cooling including the rod-like cooling water nozzle for rapid cooling are arranged at intervals 3 to 20 times the nozzle orifice diameter in the width direction of the hot rolled steel sheet subjected to cooling.

[13] The hot rolled steel sheet cooling apparatus according to the above-described [1], wherein the hot rolled steel sheet is a hot rolled steel strip having a thickness of 1 to 30 mm.

[14] The hot rolled steel sheet cooling apparatus according to the above-described [1], wherein the hot rolled steel sheet is a steel plate having a thickness of 6 to 100 mm.

According to the present invention, in cooling the upper surface of a hot rolled steel sheet (hot rolled steel strip or steel plate), uniform and stable cooling can be achieved while both of high cooling rate and low cooling rate are ensured.

For example, when the present invention is applied to cooling for a hot rolled steel sheet after finish rolling, it is possible to stably cool steel having a thickness below 2.0 mm and having a problem with its passing performance and thick steel without remarkably changing a cooling rate.

Specifically, according to the cooling apparatus of the present invention, the cooling water flow rate can be changed in a wide range while cooling is stabilized. Regarding the passing performance inherent in a thin steel strip having a thickness below 2.0 mm, the use of the gradual cooling nozzles allows stable passage of the steel strip. Furthermore, as for a steel strip having a thickness above 5 mm, since a cooling rate as high as several times that of a related art facility is ensured, a steel sheet exhibiting high strength and high toughness can be manufactured with little alloy addition.

In the case where the present invention is applied to steel plate cooling, since cooling rate can be made harder to change if steel plates have thicknesses that vary, the same properties can be derived from steel of a single composition. It is therefore possible to manufacture steel plates without adding a special element for strength, toughness, or the like as in the related art.

Moreover, since the gradual cooling header and the rapid cooling header are combined into the single cooling unit, the cooling apparatus can be installed in a small space. Accordingly, the cooling apparatus can be installed in an empty small space in, especially, an existing rolling facility. Thus, high-performance products can be manufactured.

DETAILED DESCRIPTION OF EMBODIMENTS OF THE INVENTION

An embodiment of the present invention will be described with reference to the drawings. A cooling apparatus for a hot rolled steel strip will now be described.

Figure 1:
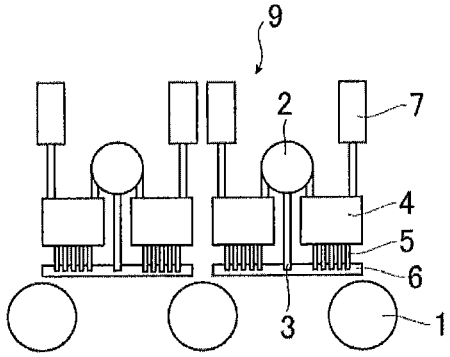
FIG. 1 is a side elevational view explaining an embodiment of the present invention.

FIG. 1 is a diagram illustrating the fundamental configuration of a cooling apparatus for the upper surface of a hot rolled steel strip according to an embodiment of the present invention.

The cooling apparatus is placed above table rollers 1 for conveying the hot rolled steel strip and includes cooling units 9 each of which includes a gradual cooling header 2, gradual cooling nozzles 3, rapid cooling headers 4, and rapid cooling nozzles 5 such that the rapid cooling header 4 and the rapid cooling nozzles 5 are arranged on each side of the gradual cooling header 2 and the gradual cooling nozzles 3 located at the middle. Each cooling unit 9 is disposed between the table rollers 1. In addition, a protector 6 is provided for ends of the gradual cooling nozzles 3 and the rapid cooling nozzles 5 in order to protect the nozzles.

The protector 6 has a plurality of guide holes for passage of cooling water. The gradual cooling nozzles 3 and the rapid cooling nozzles 5 are arranged so as to spray cooling water to the surface of the steel strip through the guide holes.

Elevators (elevating units) 7 are attached to each cooling unit 9 such that the cooling unit 9 is movable between a position close to the table rollers 1 and a position at a distance of 1000 mm or more therefrom.

The protector 6 and the cooling unit 9 are connected to each other (whose concrete structure is not illustrated) such that the protector 6 and the cooling unit 9 are moved upward or downward in unison with each other by the elevating units 7.

Figure 2:
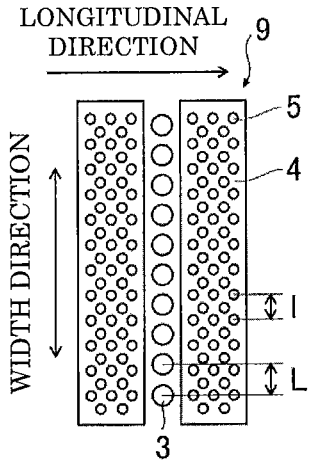
FIG. 2 is a bottom view explaining the embodiment of the present invention.

FIG. 2 illustrates the arrangement of the nozzles when the cooling unit 9 is viewed from below.

Each of the gradual cooling nozzles 3 and the rapid cooling nozzles 5 is a nozzle (rod-like cooling water nozzle) capable of spraying rod-like cooling water.

The rod-like cooling water means cooling water sprayed from a nozzle ejection port shaped in a circle (including an oval and polygon). The rod-like cooling water is not spray flow or laminar flow. It means a continuous straight stream of cooling water whose cross-section is kept in substantially a circle for the period between the time when the water is sprayed from the nozzle ejection port and the time when the water impacts on the steel strip.

The gradual cooling nozzles 3, each having a relatively large orifice diameter, are arranged in the width direction of the steel strip. The rapid cooling nozzles 5, each having a relatively small orifice diameter, are arranged in the width direction and a conveying direction of the steel strip to form a group of flows. In the following description, the width direction is simply intended to refer to the width direction of the steel strip and the conveying direction is simply intended to refer to the conveying direction of the steel strip.

Figure 3:
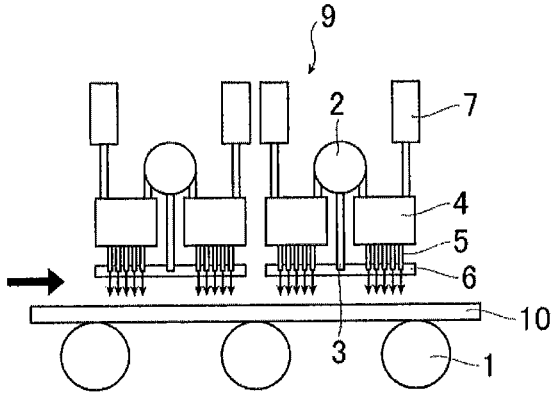
FIG. 3 is a diagram explaining rapid cooling in the embodiment of the present invention.

The rate at which a steel strip is cooled is proportional to the cooling water flow rate and is inversely proportional to the thickness of the steel strip. Steel strips to be cooled vary from, for example, steel having a thickness of 1.0 to 1.2 to steel having a thickness of 25 to 30 mm, which are minimum and maximum thicknesses of typical hot rolled steel strips. If these steel strips are cooled at the same cooling water flow rate, the cooling rate varies by about 20 to 30 times. Accordingly, as the thickness is larger, the cooling rate decreases. Since it is difficult to utilize the quenching structure of, for example, bainite or martensite, there is therefore a potential need to increase the cooling rate. When a steel strip has a relatively large thickness, therefore, the cooling units 9 are moved closer to the steel strip, 10, by the elevators 7 as illustrated in FIG. 3. In this state, cooling water is supplied to the rapid cooling headers 4 and is then sprayed from the rapid cooling nozzles 5.

Figure 4:
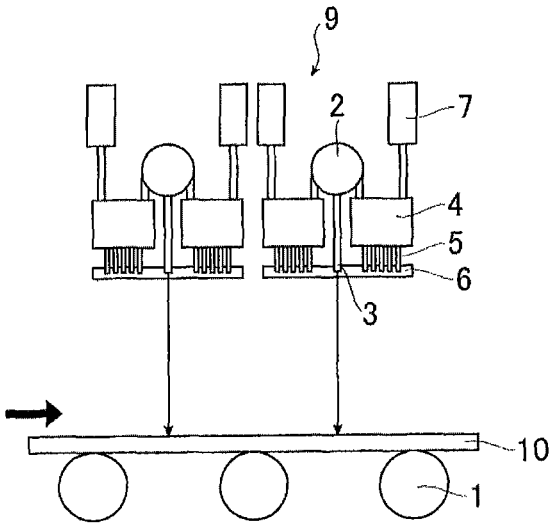
FIG. 4 is a diagram explaining gradual cooling in the embodiment of the present invention.

Regarding a steel strip having a small thickness, although a certain extent of cooling rate can be ensured even when the cooling water flow rate is low, the passing performance of the steel strip often becomes a challenge. When a steel strip having a thickness of about 1.0 to 1.2 mm is allowed to pass while being cooled, many problems may occur, for example, a lift force that occurs in the steel strip may cause the steel strip to fly and fluid resistance generated when the steel strip passes in the cooling water may reduce the speed of the steel strip to cause a loop. To resolve the flying problem, it is preferred to arrange the spay nozzles at a long distance from the table rollers 1 and cool the steel strip at a low water flow rate under low pressure in order to prevent the speed of the steel strip from being reduced by fluid resistance. While the cooling units 9 are arranged over a pass line at a distance of 1000 mm or more therefrom by the elevators 7 such that if a thin steel strip bounces while passing, the steel strip does not hit the gradual cooling nozzles 3 as illustrated in FIG. 4, therefore, cooling water is supplied to the gradual cooling headers 2 and the cooling water is sprayed from the gradual cooling nozzles 3.

In order to reduce the formation of droplets of cooling water sprayed from the gradual cooling nozzles 3 and the rapid cooling nozzles 5, each nozzle is configured such that the nozzle has a length five or more times longer than the orifice diameter.

On the other hand, when the cooling units 9 are moved closer to the steel strip 10 as illustrated in FIG. 3, the positions of nozzle outlets of the gradual cooling nozzles 3 and those of the rapid cooling nozzles 5 are arranged at substantially the same level and the protector 6 is set at this level because the nozzles may be damaged by, for example, a warp in the steel strip 10.

The ends of the gradual cooling nozzles 3 and the rapid cooling nozzles 5 may be positioned in the guide holes of the protector 6 or just over the guide holes.

As described above, the gradual cooling header 2 (the gradual cooling nozzles 3) and the rapid cooling headers 4 (the rapid cooling nozzles 5) are integrated to constitute a single cooling unit 9, thus achieving switching between rapid cooling rate and gradual cooling rate in a small space in an existing facility.

As for the arrangement of the rapid cooling nozzles 5, since the rapid cooling nozzles 5 spray water at a high flow rate, the water tends to remain on a steel strip. A steam film may occur during water cooling and cooling performance may deteriorate. It is therefore advantageous to break the steam film by arranging many nozzles each having a small nozzle orifice diameter and increasing the spray flow velocity of the nozzles. The reason for the selection of small diameter nozzles is to increase the spray flow velocity of the nozzles without increasing the amount of water supplied. To ensure temperature uniformity, the nozzles are arranged in the width direction and the conveying direction, thus forming a group of flows.

Preferably, the nozzle orifice diameter is less than or equal to 10 mm. It is preferred that the nozzles be arranged in the width direction at a pitch three to twenty times longer than the nozzle orifice diameter in order to ensure temperature uniformity in the width direction. Regarding the conveying direction, since the steel strip 10 is cooled while being conveyed, the influence of the arrangement pitch on temperature uniformity is small. The nozzles may be freely arranged in the conveying direction.

When the flow velocity at the nozzle outlets is greater than or equal to 7 m/s, a steam film can be stably broken in a range of 900° C. or less corresponding to a typical temperature of a hot rolled steel strip or steel plate. Furthermore, when nozzles having a diameter as small as possible are used as the rapid cooling nozzles 5, it is useful because the nozzle outlet flow velocity can be raised even when the supply flow rate is not changed. As the nozzle orifice diameter is smaller, there is an increase in risk of clogging caused by dust contained in cooling water. It is practically preferred that the nozzle orifice diameter be greater than or equal to 3.0 mm. If the nozzle outlet flow velocity exceeds 45 m/s, a shearing force increases due to the difference in velocity between the water and the ambient air, so that the rod-like cooling water is formed into droplets. Consequently, the force of impact decreases, so that the performance of breaking a steam film is reduced. It is therefore preferred that the nozzle outlet flow velocity be less than or equal to 45 m/s.

As the distance between the steel strip 10 and the rapid cooling nozzles 5 is shorter, it is more preferable. When the distance therebetween is shorter than five times the nozzle orifice diameter, a space for passage of the steel strip is remarkably reduced. It is not preferable because there is an increase in risk of damage of the cooling units 9 even when the protector 6 is provided. On the other hand, when cooling water is sprayed from a distance longer than fifty times the nozzle orifice diameter, the cooling water sprayed from the rapid cooling nozzles 5 tends to be formed into droplets because the used nozzles have a small diameter. Unfortunately, efficient cooling is not achieved. It is therefore preferred that the distance between the steel strip 10 and the rapid cooling nozzles 5 be five to fifty times the nozzle orifice diameter.

In the case of high flow rate cooling by the rapid cooling nozzles 5, the cooling water sprayed from the rapid cooling nozzles 5 impacts the steel strip 10 and then spreads in the conveying direction and width direction of the steel strip. Particularly, when the cooling water spreads in the conveying direction of the steel strip, the steel strip 10 is conveyed while the spreading water remains on the upper surface of the steel strip, thus causing local supercooling in a portion with the remaining water. It is therefore preferred to provide draining means on each side of the cooling unit.

Figure 5:
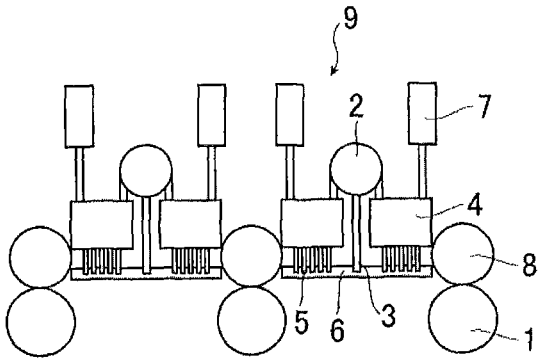
FIG. 5 is a diagram explaining draining rolls in the embodiment of the present invention.
Figure 6:
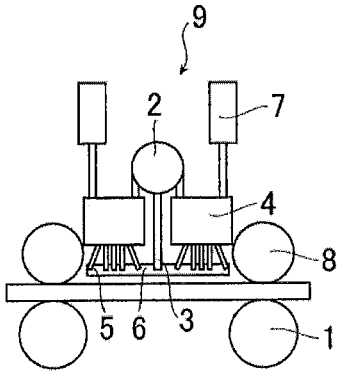
FIG. 6 is a diagram explaining a modification of the embodiment of the present invention.

As the draining means, for example, purge with high-pressure water is a typical method. This method may be used. It is preferred to arrange a draining roll 8 on each side of each cooling unit 9 as illustrated in FIG. 5. The draining rolls 8 offer high reliability because the rolls provide solid walls to drain water. Moreover, in the case where a plurality of cooling units 9 each including the rapid cooling headers 4, the rapid cooling nozzles 5, the gradual cooling header 2, and the gradual cooling nozzles 3 are arranged, water can be reliably drained in the vicinity of each unit ejecting cooling water. When the draining rolls 8 are arranged as described above, rod-like cooling water cannot be sprayed from the rapid cooling nozzles 5 to portions near the draining rolls 8 and the gradual cooling nozzles 3. Unfortunately, the cooling performance tends to decrease. When the rapid cooling nozzles 5 near the draining rolls 8 and the gradual cooling nozzles 3 are inclined and cooling water is sprayed therefrom as illustrated in FIG. 6, therefore, the rod-like cooling water uniformly impacts an area between the draining rolls 8. Thus, high cooling performance can be achieved. Regarding the cooling water flow rate, so long as the rapid cooling nozzles 5 are designed such that the flow rate per unit area of the area to be cooled by each cooling unit 9 is greater than or equal to 1000 $L/min \cdot m^2$, a cooling rate three to five times greater than that of existing laminar cooling can be obtained.

As described above with reference to FIG. 4, the gradual cooling nozzles 3 spray cooling water at a distance from the steel strip 10 at a flow rate as low as possible in terms of the passing performance of the steel strip 10. In the case where the rod-like cooling water is sprayed from a distance, when the flow velocity in the nozzles is extremely low, the cooling water is discontinuously sprayed due to the influence of the surface tension during falling, thus causing temperature variations. If the flow velocity is excessively increased, the cooling water is partly jetted and formed into droplets during falling, thus deteriorating the cooling efficiency. When the nozzle outlet flow velocity is greater than or equal to 0.4 m/s from the viewpoint of preventing the discontinuity of the cooling water due to the surface tension and is less than or equal to 3.0 m/s from the viewpoint of preventing the water from being jetted, the rod-like cooling water sprayed from the gradual cooling nozzles 3 can be allowed to impact the steel strip 10 from a distance of about 1000 mm while being as continuous flows without being jetted and being discontinuously sprayed. As the orifice diameter of the gradual cooling nozzles 3 is larger, the cooling water does not tend to be jetted and be discontinuously sprayed. It is practically preferred that the nozzle orifice diameter be greater than or equal to 10 mm and be less than or equal to 30 mm.

Figure 7:
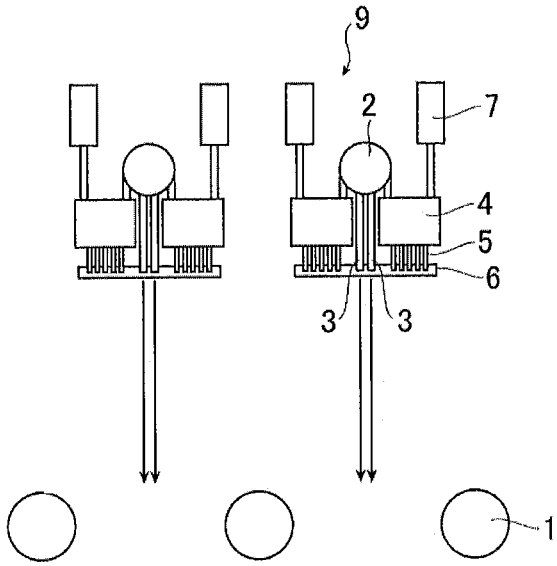
FIG. 7 is a diagram explaining another modification of the embodiment of the present invention.

As regards the arrangement pitch of the gradual cooling nozzles 3 in the width direction, when the pitch is narrower than 1.5 times the orifice diameter of the gradual cooling nozzles 3, cooling water flows sprayed from adjacent nozzles combine with each other due to arrangement deviation of the nozzles before the water flows reach the steel strip 10. This may cause temperature variations. If the pitch is greater than or equal to 20 times the nozzle orifice diameter, temperature uniformity in the width direction cannot be ensured as described above with respect to the rapid cooling nozzles 5. On the other hand, unlike the rapid cooling nozzles 5, the gradual cooling nozzles 3 do not constitute an array of nozzles. It is therefore preferred that the nozzle pitch be narrower than that of the rapid cooling nozzles 5. More preferably, the arrangement pitch of the gradual cooling nozzles 3 is less than or equal to five times the nozzle orifice diameter. Regarding the cooling water flow rate, the gradual cooling nozzles 3 may be designed such that the flow rate per unit area of the area to be cooled by each unit is 700 to 2000 $L/min \cdot m^2$. If it is difficult to design the nozzle orifice diameter, the nozzle pitch, or the nozzle outlet flow velocity in the above-described range, the gradual cooling nozzles 3 may be arranged in a plurality of rows arranged in the conveying direction as illustrated in FIG. 7. On the other hand, if three or more rows are arranged, the nozzles spray a group of flows like the rapid cooling nozzles 5, thus increasing cooling water flows. This leads to increased fluid resistance when a thin steel strip passes, thus resulting in unstable passage. It is therefore preferred to arrange one to three rows of gradual cooling nozzles 3 in the conveying direction for each cooling units 9. In this arrangement, substantially the same cooling rate as that of existing laminar cooling can be ensured.

Figure 8:
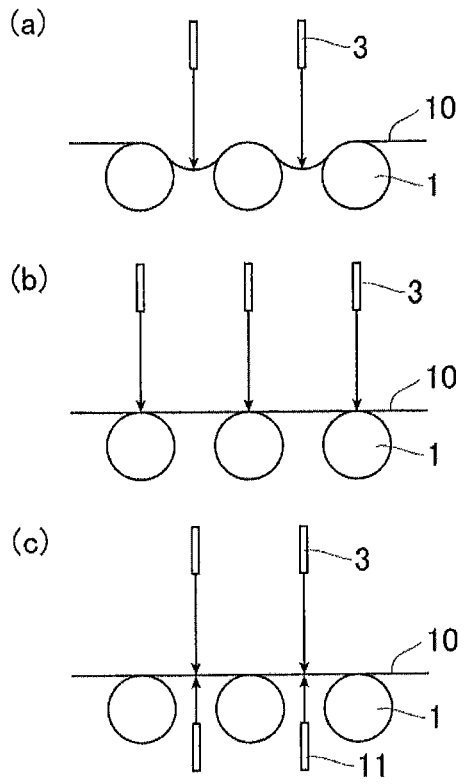
FIG. 8 includes diagrams explaining points of fall associated with gradual cooling nozzles in an embodiment of the present invention.

The reason why the gradual cooling nozzles 3 are used is to improve the passing performance of a thin steel strip depending on fluid force. FIG. 8(*a*) illustrates a schematic diagram explaining this reason. When cooling water sprayed from the gradual cooling nozzles 3 falls between the table rollers, the steel strip 10 sags due to a fluid force. In particular, as the steel strip is thinner, the stiffness is lower, so that the amount of sag increases. Since the steel strip 10 is moved, the sagging parts come into collision with the table rollers 1, thus causing the steel strip 10 to bounce. For example, therefore, cooling water sprayed from the gradual cooling nozzles 3 may be applied over the table rollers 1 as illustrated in FIG. 8(*b*). Alternatively, a lower surface cooling device 11 may be disposed between the table rollers 1 as illustrated in FIG. 8(*c*) such that the lower surface cooling device 11, facing the gradual cooling nozzles 3, sprays cooling water having the same momentum as that of cooling water sprayed from the gradual cooling nozzles 3 in order to balance fluid forces. It is preferable because sag does not occur.

Figure 9:
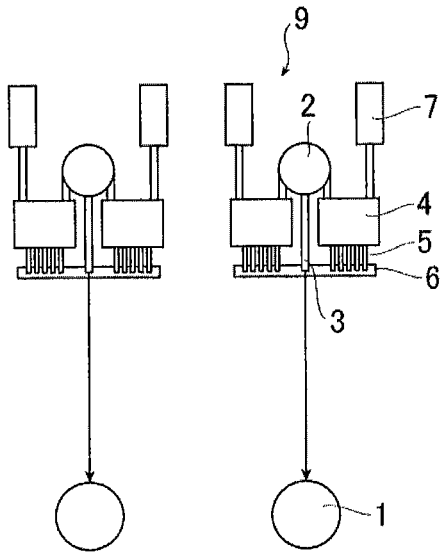
FIG. 9 is a diagram explaining another modification of the embodiment of the present invention.
Figure 10:
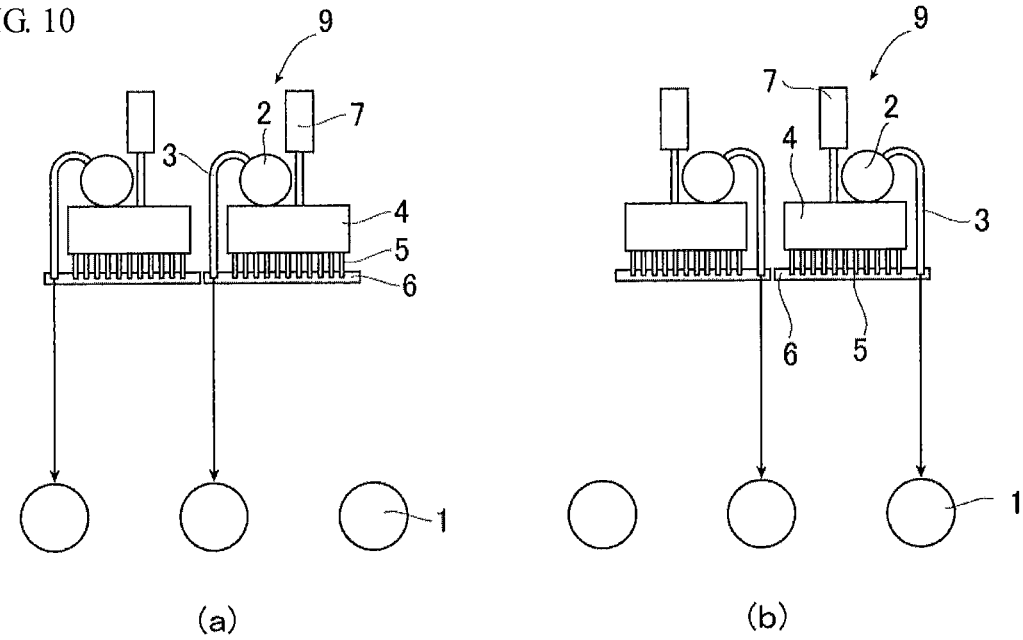
FIG. 10 is a diagram explaining another modification of the embodiment of the present invention.
Figure 11:
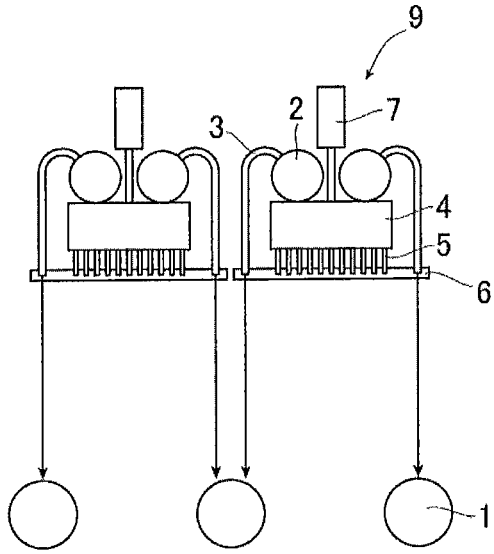
FIG. 11 is a diagram explaining another modification of the embodiment of the present invention.

Regarding the configuration of each cooling unit 9, therefore, two rapid cooling headers 4 may be arranged in the conveying direction as illustrated in FIG. 9 such that the gradual cooling header 2 and the gradual cooling nozzles 3 are arranged in the middle space between the rapid cooling headers 4. The gradual cooling header 2 may be disposed on each rapid cooling header 4 as illustrated in FIGS. 10(*a*), (*b*) such that each gradual cooling nozzle 3 is hairpin-shaped and the rapid cooling nozzles 5 are arranged upstream or downstream of the gradual cooling nozzles 3 in the conveying direction. Alternatively, in the case where the gradual cooling nozzles 3 are arranged in two rows in the conveying direction as described above with reference to FIG. 7, the hairpin-shaped gradual cooling nozzles 3 may be arranged upstream and downstream of each rapid cooling header 4 as illustrated in FIG. 11. Cooling water can fall over the table rollers 1 in any of the above-described manners.

Figure 12:
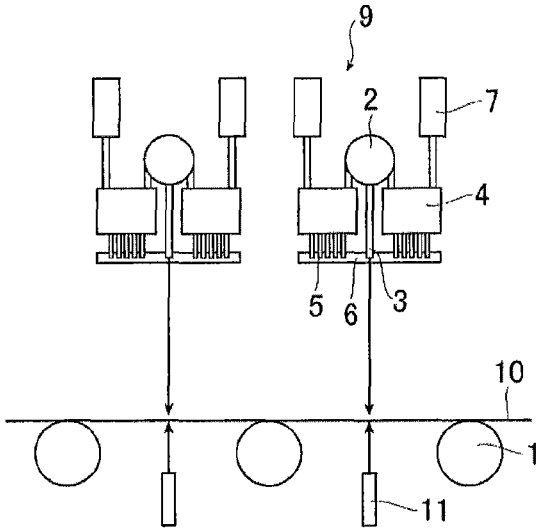
FIG. 12 is a diagram explaining another modification of the embodiment of the present invention.

In addition, the following manner may be used. As illustrated in FIG. 12, two rapid cooling headers 4 are arranged in the conveying direction such that the gradual cooling header 2 and the gradual cooling nozzles 3 are arranged in the middle space between the rapid cooling headers 4, and cooling water is allowed to fall between the table rollers 1 such that the water faces and impacts cooling water from the lower surface cooling device 11, disposed so as to face the lower surface, having the same fluid force as that of the gradual cooling nozzles 3. In this case, spay cooling nozzles or rod-like cooling water nozzles may be arranged as the lower surface cooling devices 11. The fluid force on the lower surface of the steel strip 10 may be balanced with that on the upper surface of the steel strip 10. If the fluid force on the lower surface is extremely high, the steel strip 10 may float. Whereas, if the fluid force on the lower surface is extremely low, the amount of sag by cooling water from the gradual cooling nozzles 3 may be increased and the steel strip 10 may tend to bounce. In particular, when the steel strip 10 floats, disadvantageously, driving force from the table rollers 1 is not transferred to the steel strip 10. It is therefore preferred to select a lower surface cooling device having a fluid force smaller than the sum of the weight of the steel strip 10 and the fluid force applied from the gradual cooling nozzles 3.

This embodiment has been described with respect to the hot rolled steel strip cooling apparatus. The same may apply to a steel plate cooling apparatus.

A first embodiment of the present invention provides a hot rolled steel strip manufacturing line as an application of the cooling apparatus of the present invention.

Figure 13:
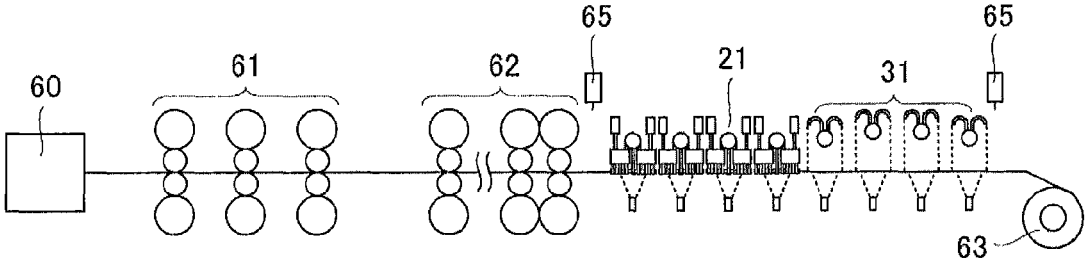
FIG. 13 is a diagram explaining a hot rolled steel strip manufacturing line according to a first embodiment of the present invention.

FIG. 13 is a diagram explaining the hot rolled steel strip manufacturing line. Referring to FIG. 13, in this hot rolled steel strip manufacturing line, a slab having a thickness of 250 mm is heated up to 1200° C. by a heating furnace 60 and is subsequently rolled at a predetermined thickness through a rough rolling mill group 61 and a finish rolling mill group 62 and is then cooled by the cooling apparatus, 21, according to an embodiment of the present invention and an existing cooling apparatus 31 and is coiled by a coiler 63. In FIG. 13, reference numeral 65 denotes a radiation thermometer.

Figure 14:
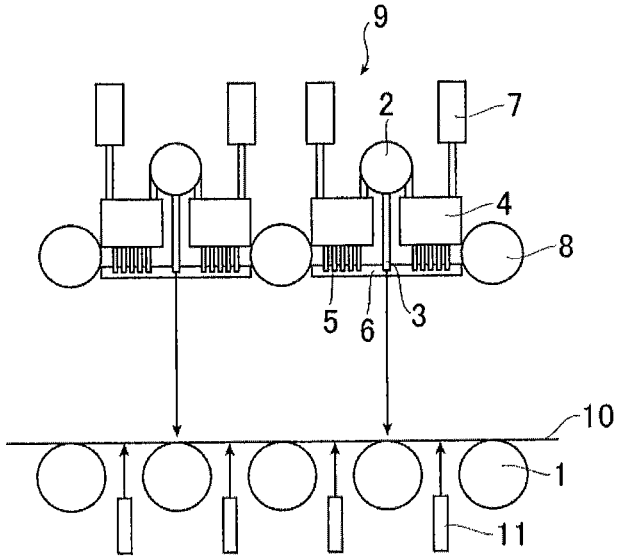
FIG. 14 is a diagram explaining a cooling apparatus in the first embodiment of the present invention.
Figure 15:
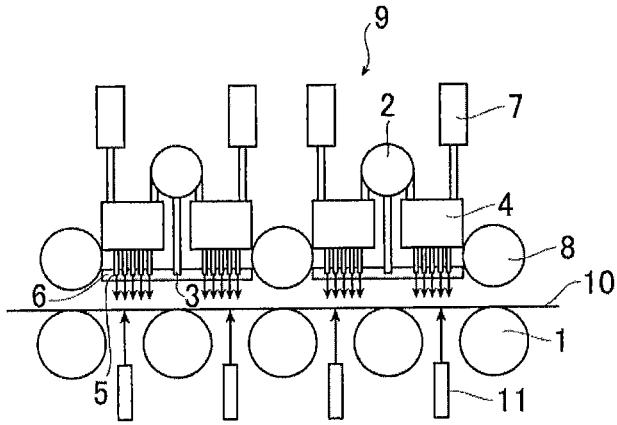
FIG. 15 is a diagram explaining the cooling apparatus in the first embodiment of the present invention.

In the first embodiment, as illustrated in FIGS. 14 and 15, the cooling apparatus 21 includes cooling units 9 each of which includes two rapid cooling headers 4, a gradual cooling header 2, and gradual cooling nozzles 3 such that the gradual cooling header 2 and the gradual cooling nozzles 3 are arranged between the headers 4, and further includes draining rolls 8, respectively arranged upstream and downstream of the rapid cooling headers 4 in the conveying direction of a steel strip, moving in unison with the cooling unit 9.

Table rollers 1 are arranged at an arrangement pitch of 370 mm and each have a diameter of 320 mm. Accordingly, each cooling unit 9, including the draining rolls 8, disposed over the upper surface is provided so as to correspond to three table rollers 1 from the viewpoint of space. The draining rolls 8 are arranged such that a pair of draining rolls 8 is provided for the table rollers 1 positioned upstream and downstream of the cooling unit 9. The gradual cooling nozzles 3 are arranged such that cooling water falls over the table roller 1.

The rapid cooling nozzles 5, each having an orifice diameter of 5 mm, are arranged at a pitch of 50 mm in the width direction and are arranged at a pitch of 70 mm in the conveying direction to form a group of flows. The rapid cooling nozzles 5 spray water at a flow velocity of 12 m/s. In this case, the water flow rate of the rapid cooling nozzles 5 in each cooling unit 9 is 4500 L/min·m$^2$.

On the other hand, the gradual cooling nozzles 3, each having an orifice diameter of 20 mm, are arranged at a pitch of 50 mm in the width direction such that a single row of gradual cooling nozzles 3 is disposed between the rapid cooling headers 4. The gradual cooling nozzles 3 spray water at a flow velocity of 0.7 m/s. In this case, the water flow rate of the gradual cooling nozzles 3 in each cooling unit 9 is 730 L/min·m$^2$.

Each cooling unit 9 is disposed such that the distance from the top of each table roller 1 and an end of each of the gradual cooling nozzles 3 and the rapid cooling nozzles 5 is 1300 mm. The cooling unit 9 is configured such that the unit is moved downward by elevators 7 and can be freely stopped in accordance with the thickness of a steel strip.

In the cooling apparatus 21, the installation length of each cooling unit 9 corresponds to two pitches (740 mm) of the table rollers 1 and thirty cooling units 9 are arranged (the total installation length is 22.2 m). Lower surface cooling devices 11 are arranged so as to face the lower surfaces of the cooling units 9 and are configured such that the water flow rate can be changed by changing spraying pressure.

The existing cooling apparatus 31 including pipe laminar nozzles and spraying nozzles is disposed downstream of the cooling apparatus 21.

To ensure a target finish cooling temperature, the cooling units 9 of the cooling apparatus 21 and the pipe laminar nozzles and spray nozzles of the existing cooling apparatus 31 are constructed such that water ejection can be independently switched between ON mode and OFF mode. The number of cooling units and the passing speed of the steel strip which can ensure a proper temperature are calculated using a computer, thus determining, for example, the cooling units to be switched to the water ejection ON mode.

EXAMPLE 1

A case where a relatively thin steel strip having a thickness of 1.6 mm was cooled in the above-described hot rolled steel strip manufacturing line will be described as Example 1.

A slab was rolled at a thickness of 32 mm through the rough rolling mill group 61 and was then rolled at a thickness of 1.6 mm through the finish rolling mill group 62. The resultant steel strip was allowed to pass through the cooling apparatus 21 such that the leading edge of the steel strip was moved at a speed of 700 mpm. When the leading edge of the steel strip was coiled by the coiler 63, the steel strip was simultaneously accelerated at 10 mpm/s.

At this time, the cooling apparatus 21 was drawn to a position at a distance of 1300 mm from the table rollers 1. Cooling water was ejected from the gradual cooling nozzles 3 to cool the steel strip up to 640° C. The lower surface cooling devices 11 were set such that the water flow rate was 500 L/min·m$^2$ and the spray flow velocity was 3 m/s.

In this manner, according to Example 1, the entire steel strip was cooled in a range of 20° C. below and above 640° C., serving as a target coiling temperature, without bouncing during passage. In this case, the cooling rate was 140° C./s for a period during which the center of the steel strip changed from 750° C. to 650° C.

EXAMPLE 2

A case where a relatively thick steel strip having a thickness of 5.0 mm was cooled will be described as Example 2.

A slab was rolled at a thickness of 40 mm through the rough rolling mill group 61 and was then rolled at a thickness of 5.0 mm through the finish rolling mill group 62. After that, the steel strip was allowed to pass through the cooling apparatus 21 such that the leading edge of the steel strip was moved at a speed of 500 mpm. When the leading end of the steel strip was coiled by the coiler 63, the steel strip was simultaneously accelerated at 2 mpm/s.

At that time, the cooling apparatus 21 was adjusted such that the distance between each table roller 1 and the end of each of the rapid cooling nozzles 5 was 30 mm (namely, the distance between the nozzle end and the steel strip was 25 mm). Cooling water was ejected from the rapid cooling nozzles 5 to cool the steel strip up to 500° C. The lower surface cooling devices 11 were set such that the water flow rate was 4500 L/min·m$^2$ and the spray flow velocity was 12 m/s.

In this manner, according to Example 2, the entire steel strip was cooled in a range of 25° C. below and above 500° C., serving as a target coiling temperature. In this case, the cooling rate was 200° C./s for a period during which the center of the steel strip changed from 750° C. to 650° C. An examination on the steel strip at that time found that the structure of the steel strip generally contained bainite and offered high strength and toughness.

According to Comparative Example 2, a steel strip having the above-described size was cooled through the gradual cooling nozzles 3. The cooling rate was 40° C./s. An examination on the steel strip at that time found that the structure contained ferrite and pearlite scattered in parts and both of the strength and the toughness were reduced.

Note that the steel strip used in Example 2 of the present invention had a composition which can have a full bainite structure so long as the cooling rate is greater than or equal to 70° C./s and cannot exhibit intended mechanical properties unless the rapid cooling nozzles 5 of the cooling apparatus 21 of the present invention are used.

EXAMPLE 3 OF PRESENT INVENTION

A case where a thick steel strip having a thickness of 25.0 mm was cooled will be described as Example 3 of the present invention.

A slab was rolled at a thickness of 80 mm through the rough rolling mill group 61 and was then rolled at a thickness of 25.0 mm through the finish rolling mill group 62. After that, the steel strip was allowed to pass through the cooling apparatus 21 of the present invention such that the leading edge of the steel strip was moved at a speed of 150 mpm. The steel strip was coiled at a constant speed by the coiler 63.

At that time, the cooling apparatus 21 of the present invention was adjusted such that the distance between each table roller 1 and the end of each of the rapid cooling nozzles 5 was 275 mm (namely, the distance between the nozzle end and the steel strip was 250 mm). Cooling water was ejected from the rapid cooling nozzles 5 to cool the steel strip up to 450° C. The lower surface cooling devices 11 were set such that the water flow rate was 8000 L/min·m$^2$ and the spray flow velocity was 17 m/s.

In this manner, according to Example 3 of the present invention, the entire steel strip was cooled in a range of 15° C. below and above 450° C., serving as a target coiling temperature. In this case, the cooling rate was 40° C./s for a period during which the center of the steel strip changed from 750° C. to 650° C. An examination on the steel strip at that time found that the structure of the steel strip generally contained bainite and the steel strip offered high strength and toughness.

According to Comparative Example 3, a steel strip having the above-described size was cooled through the gradual cooling nozzles 3. The cooling rate was 10° C./s. An examination on the steel strip at that time found that the structure contained ferrite and pearlite scattered in parts and both of the strength and the toughness were reduced.

Note that the steel strip used in Example 3 of the present invention had a composition which can have a full bainite structure so long as the cooling rate is greater than or equal to 25° C./s and cannot exhibit intended mechanical properties unless the rapid cooling nozzles 5 of the cooling apparatus 21 of the present invention are used.

[Second Embodiment]

A second embodiment of the present invention provides a steel plate manufacturing line as an application of the cooling apparatus of the present invention.

Figure 16:
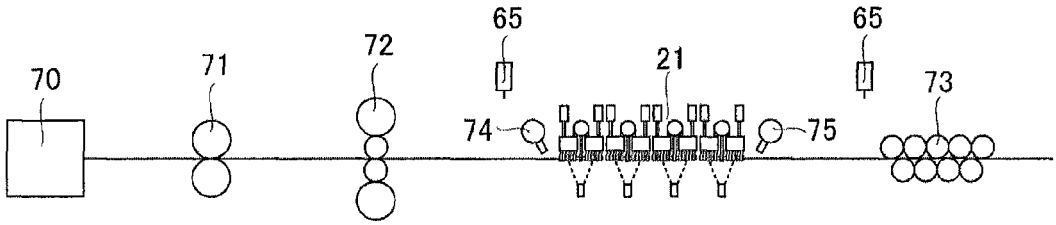
FIG. 16 is a diagram explaining a steel plate manufacturing line according to a second embodiment of the present invention.

FIG. 16 is a diagram explaining the steel plate manufacturing line as the application of the cooling apparatus of the present invention. Referring to FIG. 16, a slab having a thickness of 250 mm is heated up to 1200° C. by a heating furnace 70 and is subsequently reverse-rolled at a predetermined thickness through a rough rolling mill 71 and a finish rolling mill 72 and is cooled by a cooling apparatus 21 of the present invention and is then leveled by a roller leveler 73. After that, the steel plate is shipped. In FIG. 16, reference numeral 65 denotes a radiation thermometer.

Since steel plates are generally thicker than hot rolled steel strips, a problem associated with the passing performance does not tend to occur. As regards applicable thicknesses, however, the range of variation in thickness is wide, 6 to 100 mm. Traditionally, alloying elements have been added to a thicker steel plate, which tends to cause the cooling rate to decrease, in order to easily achieve transformation into bainite. As the thickness is larger, therefore, the cost of alloys increases. From the viewpoint of cost, therefore, it is advantageous to manufacture steel plates of a single composition such that a cooling rate changes as little as possible depending on thickness. The following description is on the assumption that a steel plate is of a kind that when the steel plate is cooled up to 500° C. at a cooling rate greater than or equal to 25° C./s, the steel plate has a stable full bainite structure.

Figure 17:
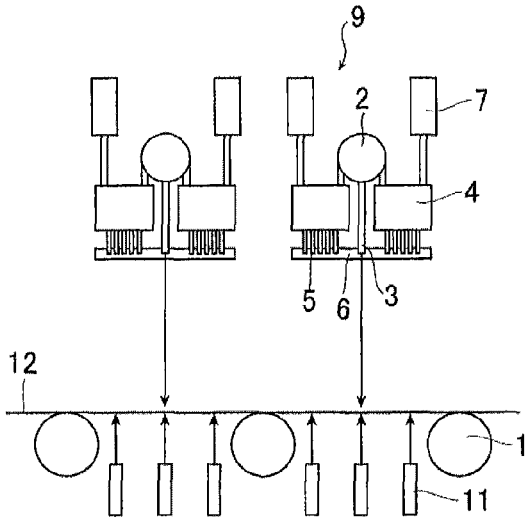
FIG. 17 is a diagram explaining a cooling apparatus in the second embodiment of the present invention.
Figure 18:
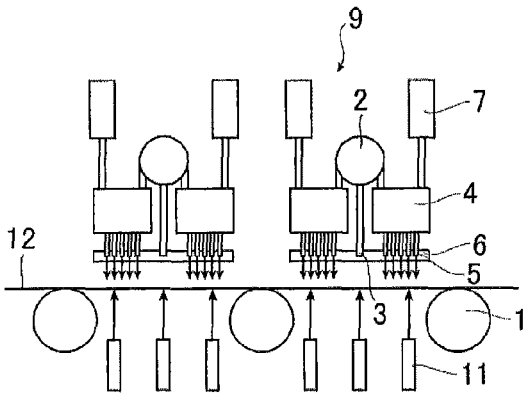
FIG. 18 is a diagram explaining the cooling apparatus in the second embodiment of the present invention.

In the second embodiment, as illustrated in FIGS. 17 and 18, the cooling apparatus 21 of the present invention includes cooling units 9 each of which includes two rapid cooling headers 4, a gradual cooling header 2, and gradual cooling nozzles 3 such that the gradual cooling header 2 and the gradual cooling nozzles 3 are arranged between the rapid cooling headers 4. Table rollers 1, each having a diameter of 450 mm, are arranged at an arrangement pitch of 1000 mm. Each cooling unit 9 is arranged over the spacing between the table rollers. The gradual cooling nozzles 3 are arranged such that cooling water falls between the table rollers.

The rapid cooling nozzles 5, each having an orifice diameter of 5 mm, are arranged at a pitch of 50 mm in the width direction and at a pitch of 70 mm in the conveying direction such that the nozzles form a group of flows. The rapid cooling nozzles 5 spray water at a flow velocity of 7 m/s. In this case, the water flow rate of the rapid cooling nozzles 5 in each cooling unit 9 is 3300 L/min·m$^2$.

On the other hand, the gradual cooling nozzles 3, each having an orifice diameter of 20 mm, are arranged at a pitch of 70 mm in the width direction such that a single row of nozzles is disposed between the rapid cooling headers 4. The gradual cooling nozzles 3 spray water at a flow velocity of 3.0 m/s. In this case, the water flow rate of the gradual cooling nozzles 3 in each cooling unit 9 is 1600 L/min·m$^2$.

Each cooling unit 9 is disposed such that the distance between the top of each table roller 1 and an end of each of the gradual cooling nozzles 3 and the rapid cooling nozzles 5 is 1000 mm. The cooling unit 9 is configured such that the unit is moved downward by elevators 7 and can be freely stopped in accordance with the thickness of a steel plate.

In the cooling apparatus 21 of the present invention, the installation length of each cooling unit 9 corresponds to one pitch (1000 mm) of the table rollers 1 and fifteen cooling units 9 are arranged (the total installation length is 15 m). Three rows of lower surface spray nozzles 11 are arranged in a traveling direction of the steel plate so as to face the lower surface of each cooling unit 9 and are configured such that the water flow rate can be changed by separately switching between the water ejection ON and OFF modes or changing spraying pressure. The gradual cooling nozzles 3 and the lower surface spray nozzles in the second row in the traveling direction of the steel plate are arranged such that cooling water flows impact the steel plate at the same position.

In addition, purge units 74 and 75, serving as draining units, capable of spraying high-pressure water, are respectively arranged upstream and downstream of the cooling apparatus 21 of the present invention.

To ensure a target finish cooling temperature, the cooling units 9 of the cooling apparatus 21 of the present invention are constructed such that water ejection can be independently switched between the ON mode and the OFF mode. The number of cooling units and the passing speed of the steel plate which can ensure a proper temperature are calculated using a computer, thus determining the cooling units to be switched to the water ejection ON mode.

EXAMPLE 4 OF PRESENT INVENTION

A case where a steel plate having a thickness of 10 mm was cooled in the above-described steel plate manufacturing line will be described as Example 4 of the present invention.

A slab was rolled at a thickness of 30 mm through the rough rolling mill 71 and was then rolled at a thickness of 10 mm through the finish rolling mill 72. After that, the steel plate was cooled by the cooling apparatus 21 of the present invention while being allowed to pass therethrough at a speed of 150 mpm.

At that time, the cooling apparatus 21 of the present invention was drawn at a position at a distance of 1300 mm from the table rollers 1. Cooling water was ejected from the gradual cooling nozzles 3 to cool the steel plate up to 500° C. As for the lower surface cooling devices 11, the group of spray nozzles of the second row from the upstream side of the three rows in the conveying direction was set such that the water flow rate was 2000 L/min·$m^2$ and the spray flow velocity was 10 m/s.

In this manner, according to Example 4 of the present invention, the entire steel plate was cooled in a range of 25° C. below and above 500° C., serving as a target finish cooling temperature. In this case, the cooling rate was 45° C./s for a period during which the center of the steel plate changed from 750° C. to 650° C.

EXAMPLE 5 OF PRESENT INVENTION

A case where a steel plate having a thickness of 25 mm was cooled will be described as Example 5 of the present invention.

A slab was rolled at a thickness of 50 mm through the rough rolling mill 71 and was then rolled at a thickness of 25 mm through the finish rolling mill 72. After that, the steel plate was cooled by the cooling apparatus 21 of the present invention while being allowed to pass therethrough at a speed of 80 mpm.

At that time, the cooling apparatus 21 of the present invention was adjusted such that the distance between each table roller 1 and the end of each of the rapid cooling nozzles 5 was 200 mm (namely, the distance between the nozzle end and the steel plate was 175 mm). Cooling water was ejected from the rapid cooling nozzles 5 to cool the steel plate up to 500° C. The lower surface cooling devices 11 were set such that the water flow rate was 6000 L/min·$m^2$ and the spray flow velocity was 12 m/s.

In this manner, according to Example 5 of the present invention, the entire steel plate was cooled in a range of 25° C. below and above 500° C., serving as a target finish cooling temperature. In this case, the cooling rate was 45° C./s for a period during which the center of the steel plate changed from 750° C. to 650° C. An examination on the steel plate at that time found that the structure of the steel plate generally contained bainite and the steel plate offered high strength and toughness.

According to Comparative Example 5, a steel plate having the same size was cooled through the gradual cooling nozzles 3. The cooling rate was 15° C./s. An examination on the steel plate at that time found that the structure contained ferrite and pearlite scattered in parts and both of the strength and the toughness were reduced.

In other words, this composition cannot exhibit intended mechanical properties unless the rapid cooling nozzles 5 of the cooling apparatus 21 of the present invention are used.

As described above, it is found that switching between using the gradual cooling nozzles 3 for relatively thin steel and using the rapid cooling nozzles 5 for relatively thick steel like in the cooling apparatus of the present invention is effective in making a cooling rate constant according to the thickness of steel, such as a steel plate.

REFERENCE SIGNS LIST

1 table roller
2 gradual cooling header
3 gradual cooling nozzle (rod-like cooling water nozzle for gradual cooling)
4 rapid cooling header
5 rapid cooling nozzle (rod-like cooling water nozzle for rapid cooling)
6 protector
7 elevator (elevating unit)
8 draining roll
9 cooling unit
10 hot rolled steel strip
11 lower surface cooling device
12 steel plate
21 cooling apparatus of the present invention (combination of gradual cooling nozzles and rapid cooling nozzles)
31 existing cooling apparatus
60 heating furnace
61 rough rolling mill group
62 finish rolling mill group
63 coiler
65 radiation thermometer
70 heating furnace
71 rough rolling mill
72 finish rolling mill
73 roller leveler
74 high-pressure water purge upstream of the cooling apparatus
75 high-pressure water purge downstream of the cooling apparatus

The invention claimed is:

1. A cooling apparatus for cooling a hot rolled steel sheet, comprising:
- a cooling unit including:
  - a gradual cooling header including a rod-like cooling water nozzle for gradual cooling; and
  - a rapid cooling header including a rod-like cooling water nozzle for rapid cooling;
  - wherein the gradual cooling header and the rapid cooling header together comprise the cooling unit; and
- an elevating unit coupled to the cooling unit, the elevating unit being configured to move the cooling unit, such that the gradual cooling header and the rapid cooling header move in unison, upward and downward with respect to a surface of the hot rolled steel sheet to a first distance for gradual cooling of the hot rolled steel sheet with the gradual cooling header and to a second distance for rapid cooling of the steel sheet with the rapid cooling header.

2. The hot rolled steel sheet cooling apparatus according to claim 1, wherein the first distance is greater than or equal to 1000 mm between the hot rolled steel sheet and an end of the gradual cooling nozzle of the gradual cooling header and wherein the second distance between the hot rolled steel sheet and an end of the rapid cooling nozzle of the rapid cooling header ranges from 5 to 50 times the orifice diameter of the rapid cooling nozzle.

3. The hot rolled steel sheet cooling apparatus according to claim 1, wherein a draining unit is disposed on each side of the cooling unit in the conveying direction of the hot rolled steel sheet.

4. The hot rolled steel sheet cooling apparatus according to claim 3, wherein the draining unit is a draining roll.

5. The hot rolled steel sheet cooling apparatus according to claim 1, wherein the rod-like cooling water nozzle for gradual cooling is disposed over a table roller conveying the hot rolled steel sheet.

6. The hot rolled steel sheet cooling apparatus according to claim 1, wherein the rod-like cooling water nozzle for gradual cooling is disposed over a spraying position of a lower surface cooling nozzle disposed between table rollers conveying the hot rolled steel sheet.

7. The hot rolled steel sheet cooling apparatus according to claim 1, wherein the cooling unit further comprises a flat protector configured to protect the rod-like cooling water nozzle for gradual cooling and the rod-like cooling water nozzle for rapid cooling, the protector has a guide hole for passage of cooling water, and cooling water is sprayed through the guide hole from the rod-like cooling water nozzle for gradual cooling and the rod-like cooling water nozzle for rapid cooling.

8. The hot rolled steel sheet cooling apparatus according to claim 1, wherein the rod-like cooling water nozzle for gradual cooling has a nozzle orifice diameter greater than or equal to 10 mm and provides a nozzle outlet flow velocity less than or equal to 3 m/s.

9. The hot rolled steel sheet cooling apparatus according to claim 1, wherein the rod-like cooling water nozzle for rapid cooling has a nozzle orifice diameter less than or equal to 10 mm and provides a nozzle outlet flow velocity greater than or equal to 7 m/s.

10. The hot rolled steel sheet cooling apparatus according to claim 1, wherein a plurality of rod-like cooling water nozzles for gradual cooling including the rod-like cooling water nozzle for gradual cooling are arranged at intervals 1.5 to 5 times the nozzle orifice diameter in the width direction of the hot rolled steel sheet subjected to cooling so as to form a cooling nozzle row, and one to three cooling nozzle rows are arranged in the header.

11. The hot rolled steel sheet cooling apparatus according to claim 1, wherein a plurality of rod-like cooling water nozzles for rapid cooling including the rod-like cooling water nozzle for rapid cooling are arranged at intervals 3 to 20 times the nozzle orifice diameter in the width direction of the hot rolled steel sheet subjected to cooling.

12. The hot rolled steel sheet cooling apparatus according to claim 1, wherein the hot rolled steel sheet is a hot rolled steel strip having a thickness of 1 to 30 mm.

13. The hot rolled steel sheet cooling apparatus according to claim 1, wherein the hot rolled steel sheet is a steel plate having a thickness of 6 to 100 mm.

14. The cooling apparatus of claim 1, wherein:

the rapid cooling header including the rod-like cooling water nozzle for rapid cooling is disposed upstream of the gradual cooling header including the rod-like cooling water nozzle for gradual cooling, or the rapid cooling header including the rod-like cooling water nozzle for rapid cooling is disposed downstream of the gradual cooling header including the rod-like cooling water nozzle for gradual cooling in a conveying direction of the hot rolled steel sheet.

15. The cooling apparatus of claim 1, wherein at the first distance only the gradual cooling header is switched on and at the second distance only the rapid cooling header is switched on.

16. A cooling apparatus for cooling a hot rolled steel sheet, comprising:

a cooling unit including:

a gradual cooling header including a rod-like cooling water nozzle for gradual cooling; and at least two rapid cooling headers including rod-like cooling water nozzles for rapid cooling, such that the gradual cooling header and the at least two rapid cooling headers together comprise the cooling unit; and an elevating unit configured to move the cooling unit upward and downward, such that the gradual cooling header and the at least two rapid cooling headers move in unison;

wherein in the cooling unit, one of the at least two rapid cooling headers including the rod-like cooling water nozzles for rapid cooling is disposed upstream of the gradual cooling header including the rod-like cooling water nozzle for gradual cooling and one of the at least two rapid cooling headers including the rod-like cooling water nozzles for rapid cooling is disposed downstream of the gradual cooling header including the rod-like cooling water nozzle for gradual cooling in a conveying direction of the hot rolled steel sheet.

* * * * *